US005699701A

United States Patent [19]

Cotten, Jr.

[11] Patent Number: 5,699,701

[45] Date of Patent: Dec. 23, 1997

[54] TOOL FOR REMOVING VEHICLE GAS TANK CAP

[76] Inventor: David L. Cotten, Jr., Rte. 2, Box 500A, Martin, Tenn. 38237

[21] Appl. No.: 646,096

[22] Filed: May 7, 1996

[51] Int. Cl.[6] ..... B67B 7/14

[52] U.S. Cl. ..... 81/3.4; 81/124.2; 81/177.5; 81/119; 81/177.6

[58] Field of Search ..... 81/3.4, 124.2, 81/121.1, 119, 177.2, 177.5, 177.6, 177.7

[56] References Cited

U.S. PATENT DOCUMENTS 2,138,725 11/1938 Brouhard ..... 81/177.7 X
3,010,346 11/1961 Kulp ..... 81/124.2
4,607,406 8/1986 Davis ..... 81/177.7 X
4,836,065 6/1989 Setliff ..... 81/3.4

*Primary Examiner*—James G. Smith
*Attorney, Agent, or Firm*—Beady, O'Boyle & Gates

[57] ABSTRACT

A tool for removing a vehicle gas tank cap having a cradle for engaging the lug on a conventional gas tank cap. One end of an extension is fixedly connected to the cradle, and a handle is pivotally connected to the other end of the extension. The handle is pivotal from a wholly contained, stored position within the extension member to various angular positions relative to the longitudinal axis of the extension member to accommodate the strength of the particular user. The tool is particularly useful for the elderly and physically handicapped, and it can be folded for storage in the glove compartment or under the front seat of the vehicle.

4 Claims, 1 Drawing Sheet

TOOL FOR REMOVING VEHICLE GAS TANK CAP

BACKGROUND OF THE INVENTION

With the advent of self-service gas stations, where the driver of the vehicle pumps the gas into the vehicle, in contrast to full-service gas stations, where an attendant pumps the gas into the vehicle, oftentimes, the drivel experiences difficulty in removing the cap from the filler tube of the gas tank. This is particularly true for the elderly and physically handicapped persons, such as those having arthritic hands.

The tool of the present invention has been devised to overcome the difficulties experienced by vehicle drivers, particularly the elderly and physically handicapped, when removing a vehicle gas tank cap.

SUMMARY THE INVENTION

The tool of the present invention comprises, essentially, a cradle adapted to engage the conventional lug on a gas tank cap. One end of an extension member is fixedly secured to the cradle, and a handle is pivotally connected to the other end of the extension member.

The handle is adapted to be pivoted to a position in alignment with the longitudinal axis of the extension member so that the tool can be manipulated in a manner similar to that of a screwdriver for removing the cap. The handle is also adapted to be pivoted to a position 90° longitudinal axis of the extension member to thereby form a crank arm to facilitate the removal of the cap.

The extension member is provided with a longitudinally extending recess, and the handle is adapted to be pivoted downwardly to be received and wholly contained within the recess for storage purposes, whereby the folded tool can be stored in either the glove compartment or underneath the front seat of the vehicle.

In use, the driver pivots the handle from the stored position to a desired position relative to the extension member most suitable for the removal of the cap which is done by placing the cradle on the cap lug and turning the handle and associated extension member.

DESCRIPTION OF THE PREFERRED EMBODIMENTS

Figure 1:
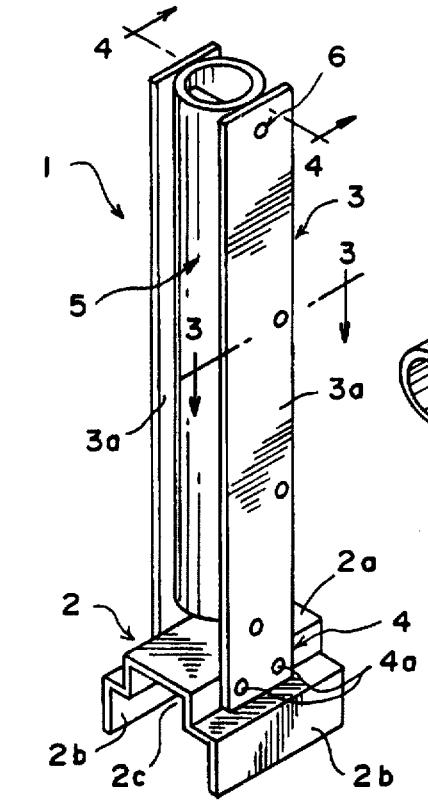
FIG. 1 is a perspective view of the tool of the present invention in the stored position.
Figure 2:
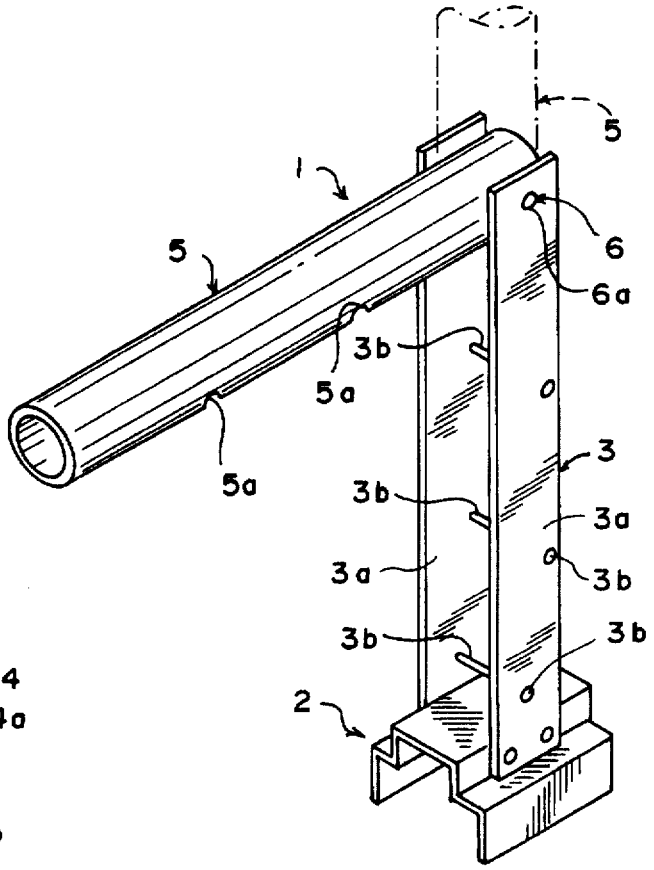
FIG. 2 is a perspective view of the tool illustrating the handle pivoted to two operative positions.
Figure 3:
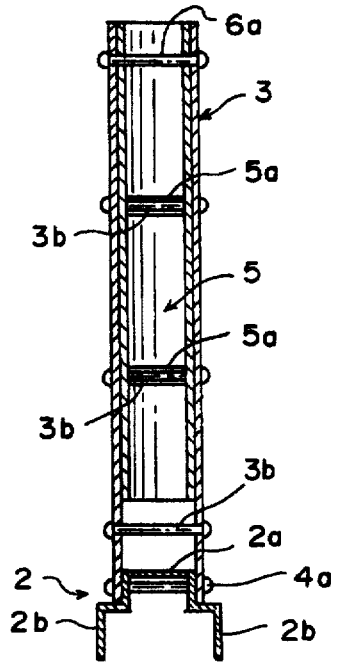
FIG. 3 is a view taken along line 3—3 of FIG. 1.

Referring to the drawings and, more particularly, to FIGS. 1 and 2, the tool 1 of the present invention comprises a cradle 2 and an extension member 3 having one end fixedly secured, as at 4, to the cradle 2, and a handle 5 pivotally connected to the opposite end of the extension member, as at 6.

Figure 5:
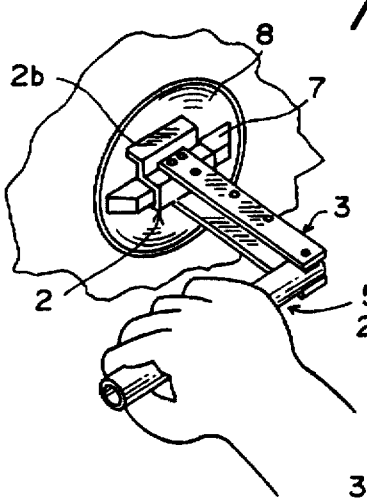
FIG. 5 is a perspective view of the tool being used to remove a gas tank cap.
Figure 4:
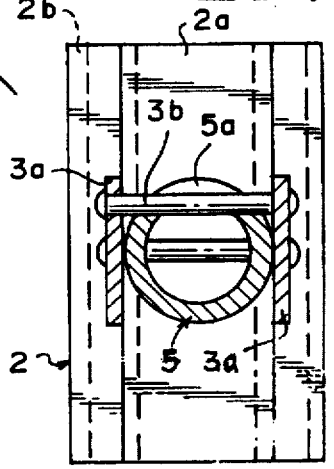
FIG. 4 is a view taken along line 4—4 of FIG. 1.

The cradle 2 comprises a piece of sheet metal bent to form a bifurcated member having a web portion 2*a* and a pair of spaced, depending legs 2*b*. The web portion 2*a* is deformed to provide a recess 2*c* adapted to receive the conventional, transversely extending lug 7 on a gas tank cap 8, as shown in FIG. 5.

The extension member 3 comprises a pair of spaced, parallel metal plate members 3*a* held in spaced relationship by a plurality of longitudinally spaced, transversely extending pins 3*b* fixedly attached to the plate members 3*a*. Suitable fasteners 4*a*, such as rivets, extend through the plate members 3*a* and web portion 2*a* of the cradle 2 for securing the cradle to one end of the extension member 3. A pivot pin 6*a* extends through the opposite end portions of the plate members 3*a* and one end of the handle 5, whereby the handle 5 is pivotally connected to the extension member 3.

The handle 5 is a tubular member having a plurality of longitudinally spaced, transversely extending slots 5*a*. The longitudinal spacing of the slots 5*a* corresponds to that of the transversely extending pins 3*b* so that the pins 3*b* are received into the slots 5*a* on the handle 5 when the handle 5 is pivoted downwardly into the space between the plate members 3*a*, whereby a recess is provided in the extension member 3 for wholly containing the handle 5 in the stored position.

In use, the driver removes the stored tool 1 from either the glove compartment or from under the front seat of the vehicle and pivots the handle 5 to either a position 9020 from the extension member 3, as shown in solid lines in FIG. 2, or to a position in alignment with the longitudinal axis of the extension member 3, as shown in phantom, in FIG. 2, depending upon which position is most accommodating to the driver. The cradle 2 is placed on the lug 7 of the gas cap 7, and the handle 5 and associated extension member 3 are turned to unscrew the cap 8 from the gas tank filler tube.

From the above description, it will be appreciated by those skilled in the art that the tool of the present invention is simple in construction and can be readily fabricated to provide a tool to facilitate the removal of a vehicle gas tank cap, particularly by the elderly and physically handicapped, and the construction and arrangement of the tool is such that the handle 5 can be pivoted to various positions to accommodate the strength of a particular user, and can further be pivoted into the extension member 3, whereby the tool can be stored when not in use.

It is to be understood that the forms of the invention herewith shown and described are to be taken as preferred examples of the same, and that various changes in the shape, size, and arrangement of parts may be resorted to, without departing from, the spirit of the invention or scope of the subjoined claims.

I claim:

1. A tool for removing a vehicle gas tank cap comprising a cradle adapted to engage a transversely extending lug integral with a conventional gas tank cap, an extension member, said extension member comprising a pair of spaced, parallel plate members, a plurality of longitudinally spaced transversely extending pins positioned in the space between the plate members and fixedly attached thereto for maintaining the plate members in spaced relationship, fastening means fixedly securing one end of said extension member to said cradle, a handle, means pivotally connecting one end of said handle to the other end of said extension member, whereby the handle can be pivoted to the operative position to various angles relative to the extension member to accommodate the particular user, and a plurality of longitudinally spaced, transversely extending slots provided in said handle, the longitudinal spacing of said slots corresponding to the longitudinal spacing of said transversely extending pins, whereby the pins are received into the handle slots when the handle is pivoted into the space between the plate members so that the handle is wholly contained within the space between the plate members for storage of the tool.

2. A tool according to claim 1, wherein the cradle comprises a piece of sheet metal bent to form a bifurcated member having a web portion and a pair of spaced depending legs, said web portion being deformed to provide a recess adapted to receive the gas cap lug.

3. A tool according to claim 1, wherein the handle is pivotal to a position 90° to the longitudinal axis of the extension member to thereby provide a crank arm for removal of the cap.

4. A tool according to claim 1, wherein the handle is pivotal to a position in alignment with the longitudinal axis of the extension member, whereby the tool can be manipulated in a manner similar to that of a screwdriver for removing the cap.

* * * * *

UNITED STATES PATENT AND TRADEMARK OFFICE

CERTIFICATE OF CORRECTION

PATENT NO. : 5,699,701

DATED : Dec. 23, 1997

INVENTOR(S) : David L. Cotten, Jr.

It is certified that error appears in the above-identified patent and that said Letters Patent is hereby corrected as shown below:

Column 1, line 8, change "drivel" to -driver-;

Column 2, line 21, change "9020" to -90°-.

Signed and Sealed this

Third Day of March, 1998

*Attest:*

*Attesting Officer*

BRUCE LEHMAN

*Commissioner of Patents and Trademarks*